US005649328A

United States Patent [19]

Martin

[11] Patent Number: 5,649,328

[45] Date of Patent: Jul. 22, 1997

[54] SHOCK ABSORBENT ABRASION RESISTANT SPORTS GARMENT

[76] Inventor: Eugene C. Martin, 10353 W. 80th, #A, Arvada, Colo. 80005

[21] Appl. No.: 420,123

[22] Filed: Apr. 11, 1995

[51] Int. Cl.[6] ..... A41D 1/06

[52] U.S. Cl. ..... 2/238; 2/227

[58] Field of Search ..... 2/238, 228, 227, 2/70, 23, 69, 2, 1, 79, 80

[56] References Cited

U.S. PATENT DOCUMENTS

| | | | |
|---|---|---|---|
| 4,894,867 | 1/1990 | Ceravolo et al. | 2/23 |
| 4,987,613 | 1/1991 | Loverdi et al. | 2/23 |
| 5,052,058 | 10/1991 | Mueller | 2/227 |
| 5,103,505 | 4/1992 | Llorens . | |
| 5,134,726 | 8/1992 | Ross | 2/2 |
| 5,136,727 | 8/1992 | Brisco | 2/70 |
| 5,210,877 | 5/1993 | Newman . | |
| 5,271,101 | 12/1993 | Speth et al. . | |
| 5,365,610 | 11/1994 | Lubahn et al. . | |

FOREIGN PATENT DOCUMENTS

| | | | |
|---|---|---|---|
| 2564706 | 11/1985 | France | 2/227 |

*Primary Examiner*—C. D. Crowder
*Assistant Examiner*—Gloria Hale

[57] ABSTRACT

A garment for wearing while In-Line Skating comprised of a pair of loose fitting outer shorts (12) and form fitting inner shorts (14). Both shorts having padded portions to absorb the impact of a fall when landing on the hips, buttocks and or coccyx. The impact protection being provided by a fixed pad (46) in the inner shorts (14) and by removable pads (32) which fit securely into pockets on the rear portion of the outer shorts (12). The outer shorts (12) also providing abrasion and cut protection by utilizing highly abrasion resistant fibers in the rear section.

4 Claims, 3 Drawing Sheets

SHOCK ABSORBENT ABRASION RESISTANT SPORTS GARMENT

BACKGROUND—FIELD OF INVENTION

This invention relates generally to the field of garments designed to cover the lower torso and, more particularly, to such garments which provide shock absorbtion and abrasion resistance to the hips, buttocks and coccygeal area of a wearer.

BACKGROUND—DESCRIPTION OF PRIOR ART

As a recreational activity, or as a means for daily exercise, the popularity of In-Line Skating is dramatically increasing. With this increase in popularity, there is also a heightened concern for safety. This concern is evident in the many safety devices used in the sport such as helmets, wrist guards, knee and elbow pads. This does however, leave one major area of the body unprotected; that of the hips, buttocks and coccyx.

To date, this specific area has yet to receive much attention. U.S. Pat. No. 5,103,505 to Llorens, Apr. 14, 1992, discloses a garment in the form of a pair of boxer-like shorts or pants with a reinforced rear panel. This panel includes a pair of pads which are positioned along either side of the center line of the rear panel. They are designed as either an inner or outer garment. The padding of this garment is neither designed for nor suitable for providing shock absorbtion to the hips or coccyx nor does it provide abrasion resistance.

U.S. Pat. No. 5,271,101 to Speth et al., Dec. 21, 1993, discloses a garment which includes a seat pad. This seat pad covers the buttocks region, the perineal region, and extends upwards to the lower front pelvic region. Again this garment is padded but it's padding is insufficient to provide shock absorbtion to the hips and coccyx nor is the wearer protected from abrasions.

U.S. Pat. No. 5,365,610 to Lubahn et al., Nov. 22, 1994, discloses a garment which has a pocket sewn into the inside surface for the receiving of a protective pad. This garment is generally worn as an undergarment and does provide for shock absorbtion. However, this garment is neither designed for nor suitable to provide abrasion resistance nor is it intended to be used as an outer garment.

U.S. Pat. No. 5,210,877 to Newman, May 18, 1993, discloses a garment which provides protection from abrasions and lacerations. However, this garment does not provide for shock absorbtion to any part of the body.

It would be desirable to provide a garment designed to be worn on the lower torso which is particularly suitable for shock absorbtion and abrasion resistance in the hips, buttocks and coccygeal regions of a wearer. It would be particularly desirable to provide such a garment which is both comfortable to wear and does not restrict other activities.

OBJECTS AND ADVANTAGES

Disclosed and claimed herein is a garment designed to overcome the shortcomings of the prior art noted above. Accordingly, several objects and advantages of my invention are:

(a) to provide a shock absorbent, abrasion resistant sports garment consisting of an inner and outer shorts;

(b) to provide a shock absorbent, abrasion resistant sports garment whereas the inner shorts contains a shock absorbing pad that is so attached to the garment as to permit the pad to automatically accommodate itself to the body and garment configuration without wadding or folding, even under extreme stress and garment agitation;

(c) to provide a shock absorbent, abrasion resistant sports garment whereas the inner shorts fits snugly preventing chaffing and retaining body heat;

(d) to provide a shock absorbent, abrasion resistant sports garment whereas the rear section of the outer shorts contains pockets for shock absorbing pads, preferably of a closed cell foam that have the configuration substantially identical to that of the pocket;

(e) to provide a shock absorbent, abrasion resistant sports garment whereas the rear section of the outer shorts are constructed of a highly abrasion resistant fiber which will reduce abrasions and cuts due to falling on abrasive surfaces;

(f) to provide a shock absorbent, abrasion resistant sports garment whereas the garment has a socially acceptable appearance.

Further objects and advantages of the shock absorbent, abrasion resistant sports garment, will become apparent from a consideration of the drawings and ensuing description.

DRAWING FIGURES

The aforementioned objects and advantages of the inventive concepts will be appreciated from the following description and accompanying drawings wherein.

Reference Numerals In Drawing

| | |
|---|---|
| 10 In-Line Skate Shorts | 12 Outer Shorts |
| 14 Inner Shorts | 16 Front Panels |
| 18 Rear Panels | 20 Center Seam |
| 22 Side Seams | 24 Inner Leg Seams |
| 26 Pocket Panels | 28 Hook and Loop Closures |
| 30 Bottom Pocket Seams | 32 Removable Foam Pads |
| 34 Outer Shorts Hem | 36 Main Panel |
| 38 Side Panel | 40 Crotch Seam |
| 42 Hip Seams | 44 Inner Shorts Hem |
| 46 Inner Shorts Pad | 48 Inner Layer |
| 50 Middle Cushioning Layer | 52 Outer Layer |
| 54 Waistband | 56 Elastic Gatherer |
| 58 Drawstring | 60 Front Pocket |
| 62 Zipper closure | 64 Waist Panel |

SUMMARY

Applicant by the way of the present invention, seeks to disclose exemplary and functional outerwear for In-Line Skating that provides protection from falls. This is accomplished by manufacturing a garment which has an outer shell of durable material and an inner liner of an elasticized material that fits snugly, extending slightly below the hem. Two removable foam pads fit into pockets at the buttocks on the outer shell, while permanent padding is incorporated into the back of the expandable liner. This dual padding system provides shock absorbtion during falls and the durable outer shell provides abrasion and cut protection to the wearer.

DESCRIPTION OF INVENTION

Figure 1:
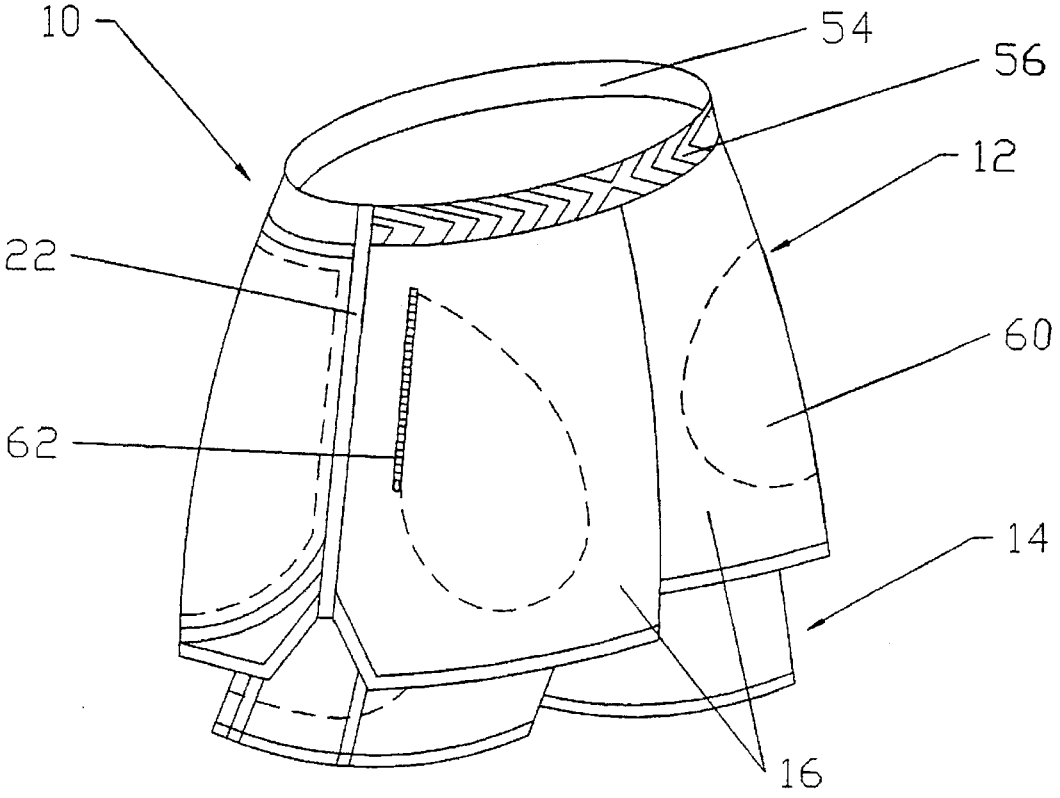
FIG. 1 is a perspective view of the sport garment of the present invention.
Figure 2:
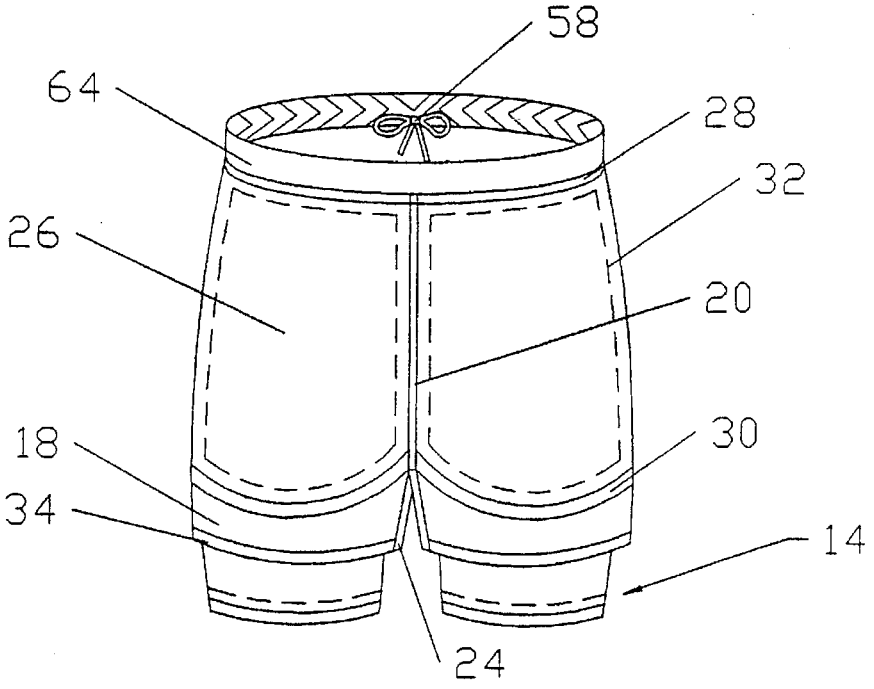
FIG. 2 is a rear view of the sport garment shown in FIG. 1.

Throughout the following detailed description, like reference numerals are used to reference the same element of the invention shown in multiple figures thereof. Referring now to the drawings and to FIGS. 1 and 2 in particular, there is shown a pair of In-Line Skate shorts 10 constructed according to the teachings of the present invention. The In-Line Skate shorts 10 are in the form of a pair of loose fitting outer shorts 12 and a pair of form fitting inner shorts 14. Outer shorts 12 are made from a pair of front panels 16 and a pair of rear panels 18 which are sewn together to form a center seam 20 which runs front to rear, a pair of side seams 22, and a pair of inner leg seams 24. In a preferred embodiment front panels 16 and rear panels 18 would be of nylon material. Over rear panels 18 there would be a waist panel 64 and a pair of pocket panels 26. Waist panel 64 and pocket panels 26 would be made of a highly abrasion resistant material and cover the entire rear section of outer shorts 12. Waist panel 64 would be sewn over the rear half of a waistband 54 and extend approximately four inches down rear panels 18.

Figure 5:
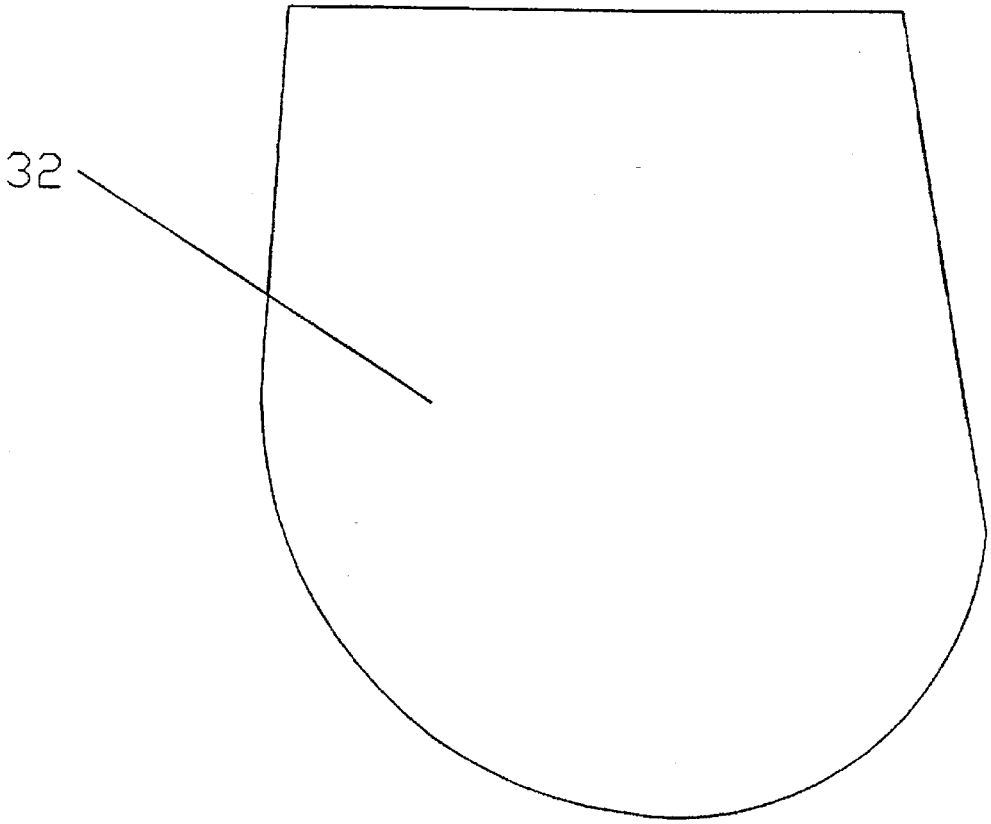
FIG. 5 is a front view of a removable foam pad shown in FIG. 2.

Pocket panels 26 would be joined to rear panels 18 by sewing them into center seam 20, side seams 22 and inner leg seams 24. The tops of pocket panels 26 would be attached to waist panel 64 just below waistband 54 with a hook and loop closure 28. The bottoms of pocket panels 26 would be secured to rear panels 18 by a bottom pocket seam 30 which would run in an arc from center seam 20 to side seam 22, thus forming pockets in which a removable foam pad 32, FIG. 5, could be held securely. Removable foam pad 32 would have a configuration similar to the pocket formed by pocket panel 26, hook and loop closure 28 and bottom pocket seam 30. Removable foam pad 32 would preferably be made from a closed cell foam. Front panels 16 and pocket panels 26 would then have the lower edges sewn to form a outer shorts hem 34.

Figure 3:
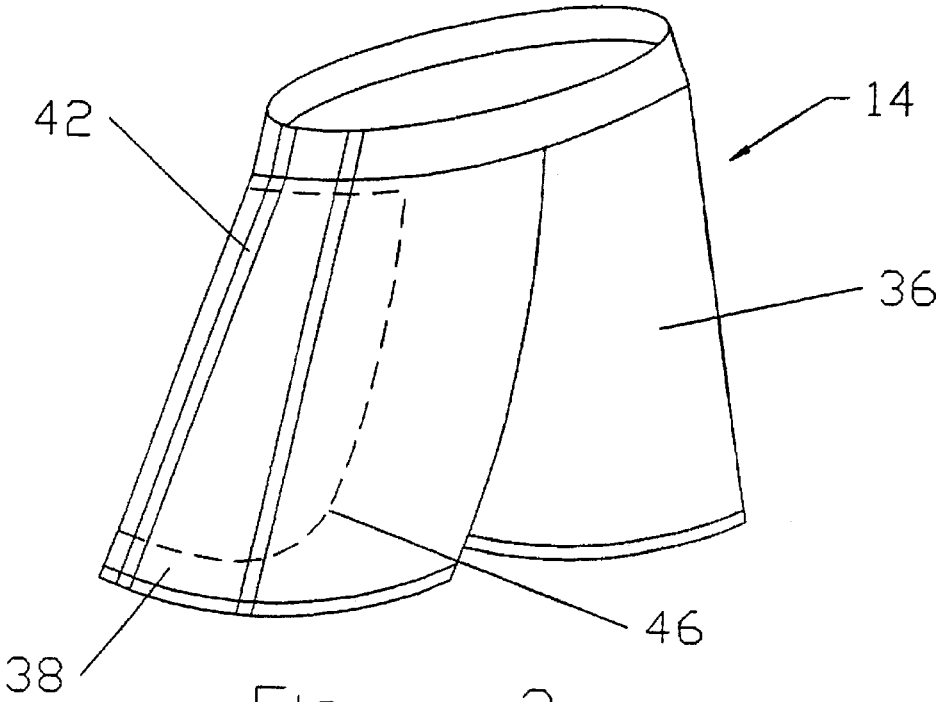
FIG. 3 is a perspective view of the inner shorts with the outer shorts shown in FIG. 1 removed.
Figure 4:
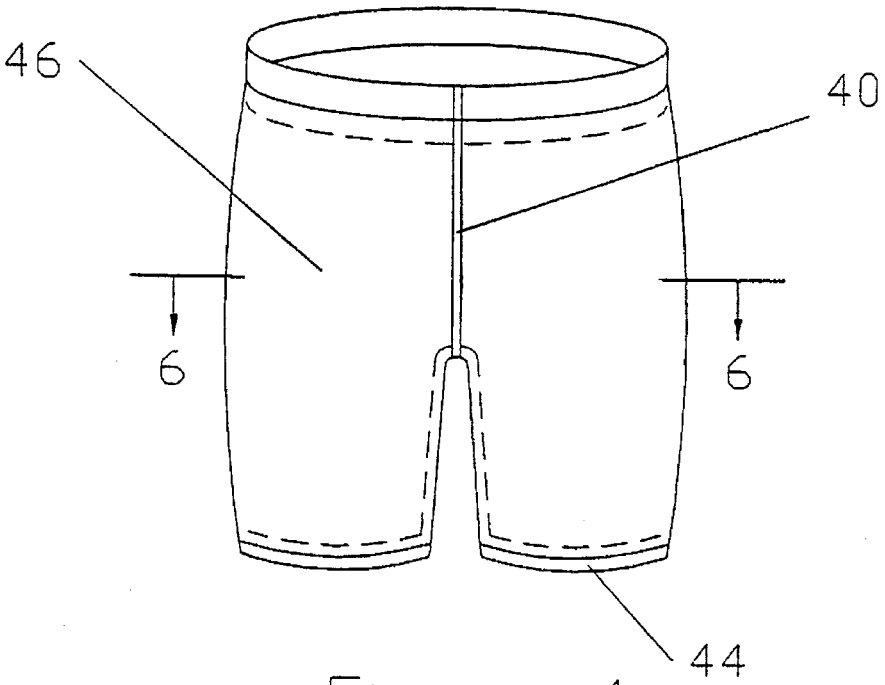
FIG. 4 is a rear view of the inner shorts shown in FIG. 3.

FIGS. 3 and 4 refer to inner shorts 14 with outer shorts 12 removed. Inner shorts 14 would preferably consist of four panels. A pair of main panels 36, and a pair of side panels 38. Main panels 36 would be sewn together forming a crotch seam 40. Side panels 38 would then be sewn to main panels 36 forming a hip seam 42. The lower edges of main panels 36 and side panels 38 would then be sewn together to form a inner shorts hem 44. Inner short pad 46 is attached to inner shorts 14 by stitching it to the inside surface thereof or, preferably, by being laminated directly to the inside surface of the material. Inner shorts pad 46 covers the hips, buttocks and coccyx of the wearer.

Figure 6:
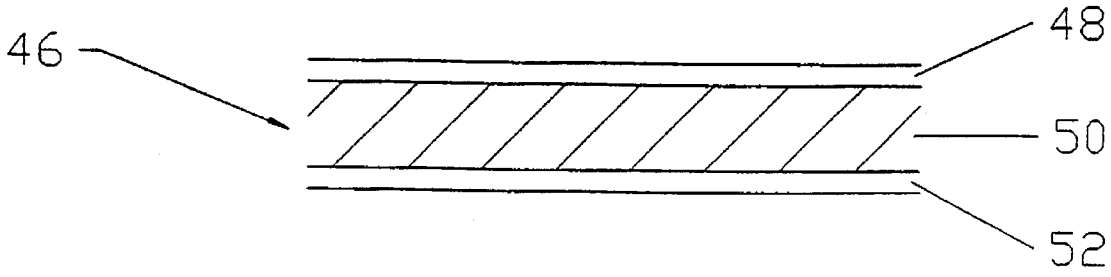
FIG. 6 is a cross section of the inner shorts pad taken along line 6—6 shown in FIG. 4.

FIG. 6 shows a cross section look at inner shorts pad 46. In a preferred embodiment of the present invention, inner shorts pad 46 would consist of three layers: inner layer 48, middle cushioning layer 50 and outer layer 52. Inner layer 48 is made from a polyester/nylon blend material. This would provide a soft blend that requires no special treatment and which dries quickly. Inner layer 48 would contact the skaters skin when In-Line Skate shorts 10 were worn by the skater. A middle cushioning layer 50 is preferably constructed form a high density open cell foam which would provide shock absorbtion in the event of a fall. Other cushioning pads such as a closed cell foam or the like could of course also be used. A outer layer 52 is preferably made of nylon tricot in order to allow inner shorts pad 46 to move with the skater. Inner layer 48, middle cushioning layer 50 and outer layer 52 are adhered together in a conventional manner prior to being attached to inner shorts 14.

Outer shorts 12 and inner shorts 14 are connected at waistband 54. This allows the two shorts to be worn as one unit, preventing slippage of one or the other pair of shorts. Waistband 54 would have a elastic gatherer 56 on the front half. There would also be a drawstring 58 to help secure the shorts in place. This embodiment also contains a front pocket 60 and a zippered closure 62. It is appreciated that various modifications to the inventive concepts may be apparent to those skilled in the art without departing from the spirit and scope of the invention.

Operation of Invention

The claimed invention is intended to be worn as an outer sports garment around the lower torso. The form fitting inner shorts 14 automatically positions the inner shorts pad 46 over the hips, buttocks and coccyx of the wearer. This inner shorts pad 46 in combination with removable foam pad 32 provide the wearer shock absorbtion. The inner shorts 14 also prevents chaffing and retain body heat. A removable foam pad 32 is located in the rear of the outer shorts 12. This removable foam pad 32 aids the inner shorts pad 46 in absorbing the impact of a fall. The rear of the outer shorts 12 have pocket panels 26 which are made of a highly abrasion resistant material. This will protect the wearer from abrasions and cuts caused from falling on paved and abrasive surfaces which are required for In-Line Skating. The waistband 54 along with the elastic gatherer 56 and drawstring 58 provide a secure fit which will keep the shorts in place even in the worst fall. The front pocket 60 with its zipper closure 62 give the wearer a secure place for change, keys and other small items. The overall appearance of the invention is such that the wearer can comfortably wear them into stores, restaurants and other non-skating situations.

Conclusion, Ramifications, and Scope of Invention

Thus the reader can see that In-Line Skating is very strenuous, requiring vigorous movement of the limbs and body. Since falls are inevitable, padding is needed for shock absorbtion which prevents injuries. The abrasive resistant material helps to avoid skin burns that occur when skidding on the paved and abrasive surfaces required for the activity. Therefore, these specially padded shorts are the ideal garment for the sport. They are shock absorbent, abrasion resistant and the tightly fitted liners prevent chaffing and retain body heat.

While my above description contains many specificity's, these should not be construed as limitations on the scope of the invention, but rather as an exemplification of one preferred embodiment thereof. Many other variations are possible. For example, the outer shorts could have an exterior drawstring, or belt loops. A walking shorts could also replace the loose fitting shorts for the outer garment. A fly opening could be designed into the shorts to accommodate the use of the restroom. The inner and outer shorts could be attached at the waistband with a hook and loop fastener in order to remove either the inner or outer shorts for those who seldom fall. The outer shorts could be replaced by a skirt for women. Although depicted as shorts, this garment may extend to the knees or even to the ankles. The materials used to manufacture the garment can vary as can the size and color. Accordingly, the scope of the invention should be determined not by the embodiment(s) illustrated, but by the appended claims and their legal equivalents.

I claim:

1. A shock absorbent sports garment comprising, in combination:

(a) an inner form fitting garment having an inner surface, a waist opening and two leg openings;

a one piece shock absorbing pad shaped and sized to entirely cover the hips, buttocks and coccyx of a wearer affixed to the inner surface of the form fitting inner garment;

(b) an outer loose fitting garment having a waist opening and two leg openings;

said outer loose fitting garment having a rear section covering said buttocks of said wearer including a pair of pockets attached to said rear area; and a pair of removable shock absorbing pads having a configuration identical to that of said pockets wherein said pads may be inserted in said pockets or removed as desired; and (c) a means for attaching said waist opening of said inner form fitting garment to said waist opening of said outer loose fitting garment so that said inner garment is within said outer garment.

2. A garment as claimed in claim 1 wherein said rear area of said outer loose fitting pair garment is constructed of a highly abrasion resistant material.

3. A garment as claimed in claim 1 wherein said outer loose fitting garments shock absorbing pad is formed of closed cell foam and said inner form fitting garments shock absorbing pad is formed of a high density open cell foam.

4. A garment as claimed in claim 2 wherein said high abrasion resistant material is formed of nylon.

* * * * *